US010508012B2

(12) United States Patent
Ramnarain et al.

(10) Patent No.: US 10,508,012 B2
(45) Date of Patent: Dec. 17, 2019

(54) UNIVERSAL SYNCHRONIZED CAPPING MACHINE

(71) Applicant: PSR Automation Inc., Shakopee, MN (US)

(72) Inventors: David R. Ramnarain, Shakopee, MN (US); Brian D. Ramnarain, Shakopee, MN (US); Christopher D. Ramnarain, Shakopee, MN (US)

(73) Assignee: PSR AUTOMATION INC., Shakopee, MN (US)

( * ) Notice: Subject to any disclaimer, the term of this patent is extended or adjusted under 35 U.S.C. 154(b) by 150 days.

(21) Appl. No.: 15/893,245

(22) Filed: Feb. 9, 2018

(65) Prior Publication Data

US 2019/0248637 A1 Aug. 15, 2019

(51) Int. Cl.

| | |
|---|---|
| ***B67B 3/26*** | (2006.01) |
| ***B67B 3/20*** | (2006.01) |
| ***B65B 59/02*** | (2006.01) |

(52) U.S. Cl.

CPC ..... *B67B 3/264* (2013.01); *B65B 59/02* (2013.01); *B67B 3/2046* (2013.01); *B67B 3/26* (2013.01)

(58) Field of Classification Search

CPC .. B67B 3/00; B67B 3/20; B67B 3/204; B67B 3/2046; B67B 3/206; B67B 3/26; B67B 3/261; B67B 3/264; B67B 3/265; B67B 3/28; B65B 7/2835; B65B 59/02

USPC ..... 53/67–69, 72, 74–76, 313–315, 317, 53/331.5, 368

See application file for complete search history.

(56) References Cited

U.S. PATENT DOCUMENTS

| | | | | | |
|---|---|---|---|---|---|
| 1,172,447 | A * | 2/1916 | Forte | B67B 3/2073 | 53/331.5 |
| 2,479,822 | A * | 8/1949 | Enkur et al. | B67B 3/2046 | 198/626.6 |
| 2,658,654 | A * | 11/1953 | Schweizer | B67B 3/2046 | 53/318 |
| 2,909,879 | A * | 10/1959 | Hohl et al. | B67B 3/2046 | 53/331.5 |
| 3,435,587 | A * | 4/1969 | Weller | B67B 3/2046 | 53/317 |
| 3,623,292 | A * | 11/1971 | Barnes | B67B 3/2046 | 53/331.5 |
| 3,807,134 | A * | 4/1974 | Zalkin | B67B 7/164 | 53/331.5 |
| 3,890,851 | A * | 6/1975 | Lanes | B67B 3/2046 | 74/400 |
| 3,905,177 | A * | 9/1975 | Herzog | B67B 3/2046 | 53/314 |
| 4,559,760 | A * | 12/1985 | Daniels et al. | B65B 59/02 | 53/314 |

(Continued)

FOREIGN PATENT DOCUMENTS

| | | | | |
|---|---|---|---|---|
| DE | 4132695 A1 * | 4/1993 | B67B 3/2046 | |
| EP | 3112275 A1 * | 1/2017 | B65B 7/2835 | |

*Primary Examiner* — Stephen F. Gerrity

(74) *Attorney, Agent, or Firm* — Dewitt LLP; Thomas J. Nikolai

(57) ABSTRACT

Automated setup and operation of a container capping machine is achieved by providing motors, each under computer control, to make the necessary adjustments regarding setup and operation, and a plurality of sensors and other devices adapted to send information related to container and cap configurations and machine operation to the computer.

13 Claims, 5 Drawing Sheets

(56) References Cited

U.S. PATENT DOCUMENTS

| | | | | |
|---|---|---|---|---|
| 4,995,781 | A * | 2/1991 | Herzog | B65G 47/1421 53/314 |
| 5,007,228 | A * | 4/1991 | Herzog | B67C 7/0026 53/317 |
| 5,398,485 | A | 3/1995 | Osifchin | |
| 5,400,564 | A | 3/1995 | Humphries et al. | |
| 5,419,094 | A | 5/1995 | Vander Bush, Jr. et al. | |
| 5,440,494 | A * | 8/1995 | Akamaru | B67B 3/26 700/105 |
| 5,669,209 | A * | 9/1997 | Dewees et al. | B65B 7/2835 53/314 |
| 6,023,910 | A * | 2/2000 | Lubus et al. | B67B 3/2046 53/317 |
| 7,003,927 | B2 * | 2/2006 | Yang | B65B 7/2835 53/317 |
| 7,325,369 | B2 * | 2/2008 | Jalbert | B65B 7/2835 53/317 |
| 9,440,801 | B1 | 9/2016 | Ramnarain et al. | |
| 2007/0095018 | A1 * | 5/2007 | Perazzo et al. | B67B 3/2046 53/317 |
| 2010/0115888 | A1 * | 5/2010 | Bassani et al. | B67B 3/261 53/396 |
| 2014/0237944 | A1 * | 8/2014 | Hahn | B65B 59/02 53/411 |

* cited by examiner

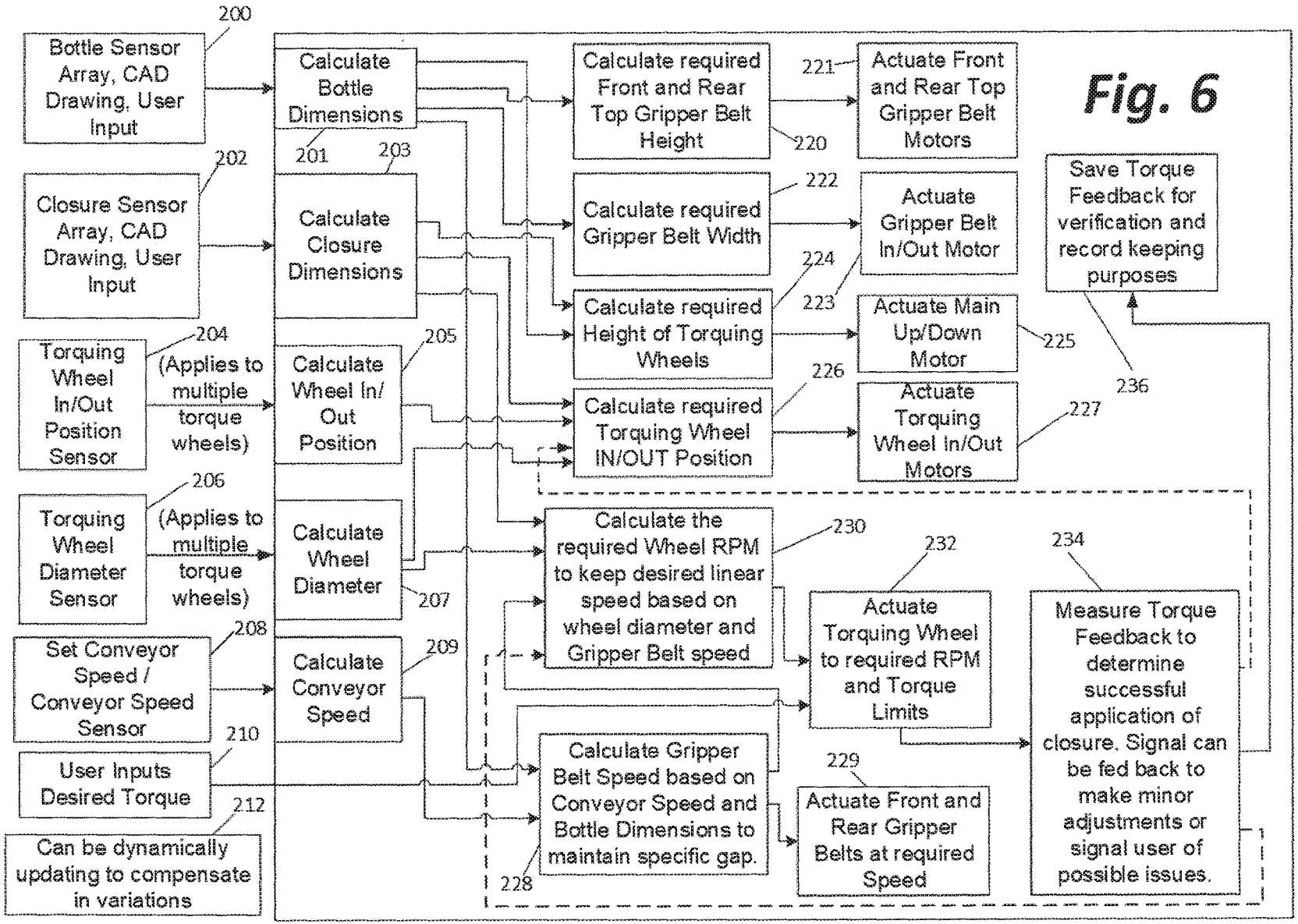
Fig. 6
Bottle Sensor Array, CAD Drawing, User Input
200
Closure Sensor Array, CAD Drawing, User Input
202
Torquing Wheel In/Out Position Sensor
204
(Applies to multiple torque wheels)
Torquing Wheel Diameter Sensor
206
(Applies to multiple torque wheels)
Set Conveyor Speed / Conveyor Speed Sensor
208
User Inputs Desired Torque
210
Can be dynamically updating to compensate in variations
212
Calculate Bottle Dimensions
201
Calculate Closure Dimensions
203
Calculate Wheel In/ Out Position
205
Calculate Wheel Diameter
207
Calculate Conveyor Speed
209
Calculate required Front and Rear Top Gripper Belt Height
220
Calculate required Gripper Belt Width
222
Calculate required Height of Torquing Wheels
224
Calculate required Torquing Wheel IN/OUT Position
226
Calculate the required Wheel RPM to keep desired linear speed based on wheel diameter and Gripper Belt speed
230
Calculate Gripper Belt Speed based on Conveyor Speed and Bottle Dimensions to maintain specific gap.
228
Actuate Front and Rear Top Gripper Belt Motors
221
Actuate Gripper Belt In/Out Motor
223
Actuate Main Up/Down Motor
225
Actuate Torquing Wheel In/Out Motors
227
Actuate Torquing Wheel to required RPM and Torque Limits
232
Actuate Front and Rear Gripper Belts at required Speed
229
Save Torque Feedback for verification and record keeping purposes
236
Measure Torque Feedback to determine successful application of closure. Signal can be fed back to make minor adjustments or signal user of possible issues.
234

UNIVERSAL SYNCHRONIZED CAPPING MACHINE

CROSS-REFERENCED TO RELATED APPLICATIONS

Not applicable

STATEMENT REGARDING FEDERALLY SPONSORED RESEARCH OR DEVELOPMENT

Not applicable

BACKGROUND OF THE INVENTION

I. Field of the Invention

The present invention relates to containers having threaded openings designed to be closed with a cap having corresponding threads. More specifically, the present invention relates to machines employed during a filling operation to automatically fasten such a cap to such a container.

II. Related Art

Containers of a wide variety of shapes and sizes are used to package commercial products. Bottles and jars having threaded openings are commonly used to package everything from beverages, to medicines, to cosmetics, to liquids such as oil, fuel additives, antifreeze, and windshield washer fluids, to cleaning solutions, etc. Containers of various shapes and sizes are used to store and ship such products. Seven examples of such bottles and jars are illustrated in FIG. 1.

Just as there are numerous container designs in use, the caps for those containers vary in design. As illustrated in FIG. 2, the diameter and height of the caps can vary to accommodate the specific design of the threaded neck surrounding the opening of the container. Further the pitch of the threads, the number of threads, and the number of turns of the threads of the cap and container vary and certainly are not universal.

Further, when containers and caps are molded out of plastic, slight (but significant) variations occur between containers and caps of the same design. This often relates to subtle differences between mold cavities used to form the bottles or the caps. Another cause relates to changes that occur and inconsistencies that arise during molding operations carried out on a mass production basis. Other subtle but significant differences between containers and caps exist because of the way they are stored prior to being filled. Climate and forces containers and caps encounter can lead to subtle changes in shape.

For many years efforts have been made to develop machines able to automatically apply a cap to a container. Examples of such machines are illustrated in U.S. Pat. No. 5,400,564 granted to Humphries et al. on Mar. 28, 1995, U.S. Pat. No. 5,398,485 granted to Osifchin on Mar. 21, 1995, and U.S. Pat. No. 5,419,094 granted to Vander Bush, Jr. et al. on May 30, 1995. Such machines work well when the bottles and caps are all of the same design. However, modifications to accommodate changes in container or cap designs are expensive, mechanically difficult, and time consuming. Thus, such machines are typically used with only a single bottle/cap combination.

Various efforts have been made in the prior art to develop a suitable capping machine that can accommodate bottles and caps of different sizes during different production runs. However, for these machines to perform a capping operation with bottles and caps of differing designs, numerous complex mechanical adjustments must be made. These adjustments must be made in a coordinated fashion and any inaccuracy in even one of these adjustments will adversely impact packaging of the products. Further, to make these adjustments, great skill and substantial experience is required. With each new bottle and cap combination, substantial investigation, measurement and much trial and error is required to make the adjustments necessary for the machine to work in an acceptable fashion. Further still, there is much employee turnover in filling plants requiring the training and learning curve to begin again. When a plant runs three shifts, different people are involved in making the necessary adjustments and there is often no documentation that accurately records the adjustments made so that they can be easily repeated either by the same operator or a different operator.

SUMMARY OF THE INVENTION

The present invention provides a universal synchronized capping machine that can be automatically adjusted under computer control to work effectively with multiple container and cap configurations to apply caps to filled containers. The universal synchronized capping machine permits all adjustments necessary to accommodate different container and cap designs to be made under computer control in less than a minute. Minor adjustments to accommodate non-uniformity of containers or caps of a particular design are made on the fly. The universal synchronized capping machine also caps containers at a sufficiently high rate of speed and with a sufficiently low failure rate to be acceptable to bottling plants.

The universal synchronized capping machine includes a cap delivery module that carries caps from a cap orienting machine such as that shown in U.S. Pat. No. 9,440,801 to Ramnarain et al. granted Sep. 13, 2016, and incorporated by reference. The cap delivery module includes a cap chute that carries the properly oriented caps from the cap orienting machine to a cap foot. The cap foot is adapted to present caps to the top of the containers as they pass beneath the cap foot.

The containers are carried by the capping machine's container conveyor module. The container conveyor module comprises:

(a) a horizontally oriented conveyor driven by a first motor, (b) a first gripper belt assembly mounted adjacent a first side of the horizontally oriented conveyor, (c) a second gripper belt assembly mounted adjacent a second opposing side of the horizontally oriented conveyor, and (d) a motor coupled to a shaft operable to alter (and control) the distance between the first and second gripper belt assemblies.

Each of the gripper belt assemblies has an upper vertically oriented gripper belt and a lower vertically oriented gripper belt. Each gripper belt assembly also has its own motor and shaft for driving at a controlled speed the upper and lower vertically oriented gripper belts. Each gripper belt assembly also has its own motor and shaft for adjusting and controlling the distance between upper and lower gripper belts. The horizontally oriented conveyor carries containers through the capping machine. The upper and lower gripper belts of the two gripper assemblies engage the sides of each container to keep it from tipping. In the case of rectangular containers, the motors driving the horizontal conveyor and gripper belts are synchronized to operate at the same speed. In the case of round containers, the speeds of the horizontal conveyor and the gripper belts are synchronized, yet operate at different speeds, if spin is to be imparted to the container as it is carried through the capping machine.

The capping machines further include a modular torque assembly. The modular torque assembly includes a motor and shaft used to adjust and control the height of the modular torque assembly relative to the horizontally oriented conveyor. The modular torque assembly also includes a cap restraint that engages the top of a cap placed on a container to hold the cap in place during at least an initial phase of the process of twisting the cap onto the container. Once the threads of the cap and container become sufficiently engaged, the work of the cap restraint is complete.

The torque assembly is modular because it may include one or more torque modules. Additional torque modules increase the throughput (i.e., containers per unit of time) of capped containers through the capping machines. Each torque module comprises a first and second torque unit. Each of the first and second torque units comprise a motor and shaft that spins a torque wheel. Each torque module also includes another motor and shaft used to adjust the distance between the two wheels so that the wheels properly engage the caps. The rate at which the torque wheels spin is adjusted and controlled via the motors coupled thereto in a synchronized fashion with the container conveyor module so that the torque modules employed spin the caps sufficiently so the caps are in a tightly sealed condition on the containers as the containers exit the capping machine.

The capping machine also includes a controller under program control adapted to independently and automatically control each of the various motors described above in a synchronized fashion to accommodate containers and caps of different sizes and shapes and having threads of different pitches or numbers of turns.

The capping machine also typically employs a plurality of sensors that communicate with the controller to provide feedback control. Some of the sensors may send signals to the controller which are used by the controller to ascertain the physical characteristics of the containers and caps. These signals are used by the controller to generate signals to the motors modifying the operation of the machine based in such physical characteristics. To set up the capping machines, signals may be sent first to the motors that control (a) the height of the modular torque assembly relative to the horizontally oriented conveyor, (b) the distance between the upper and lower vertically oriented gripper belts of each of the first and second gripper belt assemblies, and (c) the distance between the torque wheels of each torque module. To control the operation of the capping machine once it is set up, signals are sent by the controller to the motors that control the speeds of the horizontally oriented conveyer, the gripper belts and the torque wheels. Micro-adjustments may be made on the fly to account for variations between containers and caps to ensure a cap is fully secured to each container.

In addition to (or in place of) the sensors, the attributes of the containers and caps may be supplied to the controller in various other ways. Such attributes may be supplied through a hardwired (e.g., USB, fire wire, thunderbolt or Ethernet) or wireless (e.g., Wi-Fi or Bluetooth) connection by a peripheral computing device such as a desktop computer, server, laptop computer, tablet computer or even a smartphone. The controller can also have its own human/machine interface including a keyboard and display for entering such attributes. The controller may also have a card slot or port to permit a mobile storage device on which container and cap attributes are stored to be coupled to the controller. Likewise, a bar code or some similar type of code may be supplied to the controller using a code scanner enabling the container to select from a plurality of sets of container and cap attributes already stored on the controller.

The controller itself comprises a processor, random access and read only memory, storage, an input/output module to which the sensors and motors are electronically coupled, and various communications devices (e.g., Ethernet, or serial ports, and a wireless communication card). The controller, as suggested above, may have a card slot equipped to read a solid state storage device such as an SD or compact flash card, and a scanner for reading codes associated with container and cap types.

These and other attributes will be better understood from reading the following detailed description in conjunction with the accompanying drawings.

BRIEF DESCRIPTION OF THE DRAWINGS

The foregoing features, objects and advantages of the invention will become apparent to those skilled in the art from the following detailed description and with reference to the following drawings in which like numerals in the several views refer to corresponding parts:

FIG. 6 is a flow chart showing the set up and operation of the machine of FIG. 3.

DETAILED DESCRIPTION

Figure 1:
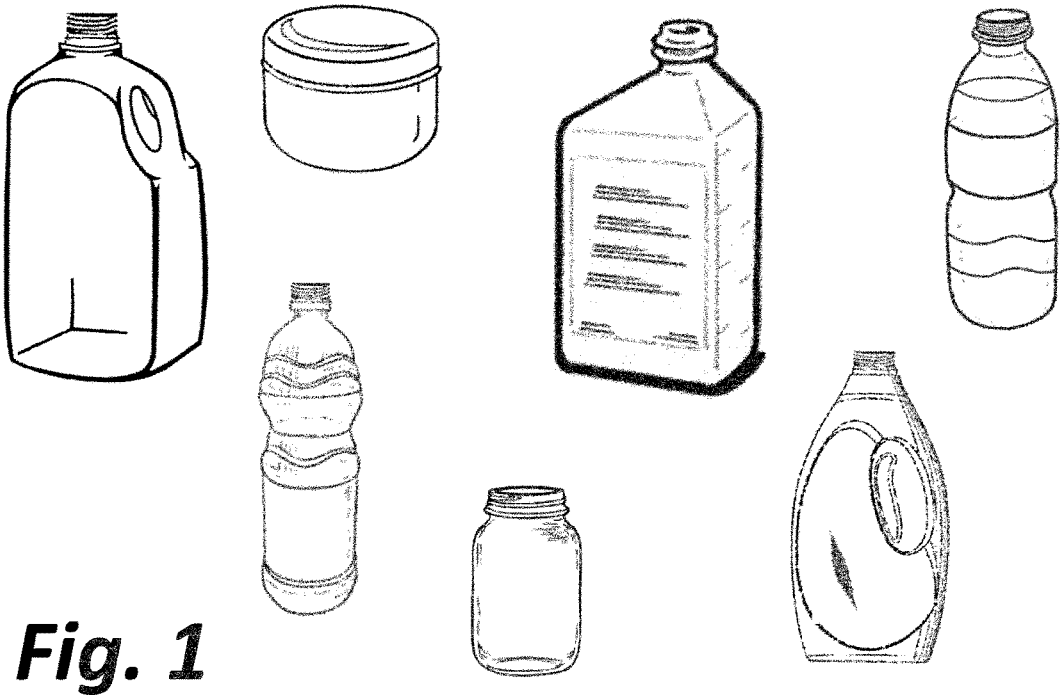
Fig. 1 (Prior Art)
FIG. 1 is an illustration of various container designs known in the prior art.

In the following detailed description, reference is made to various exemplary embodiments in which the invention may be practiced. These embodiments are described with sufficient detail to enable those skilled in the art to practice the invention, and it is understood that other embodiments may be employed, and that structural and other changes may be made without departing from the spirit or scope of the present invention.

This description of the preferred embodiment is intended to be read in connection with the accompanying drawings, which are to be considered part of the entire written description of this invention. In the description, relative terms such as "lower", "upper", "horizontal", "vertical", "above", "below", "up", "down", "top" and "bottom", "under", as well as derivatives thereof (e.g., "horizontally", "downwardly", "upwardly", "underside", etc.) should be construed to refer to the orientation as then described or as shown in the drawings under discussion. These relative terms are for convenience of description and do not require that the apparatus be constructed or operated in a particular orientation. Terms such as "connected", "connecting", "attached", "attaching", "joined", and "joining" are used interchangeably and refer to one structure or surface being secured to another structure or surface or integrally fabricated in one piece unless expressly described otherwise.

As illustrated in FIG. 1, many different containers are in common use. They vary in shape and size. Some are round and others are generally rectangular when viewed from the top or bottom. Some plastics containers have thick walls and do not deform much under pressures they typically encounter. Many have very thin walls, typically to reduce the amount of plastic employed as a cost containment measure. These containers are easily deformed under even slight pressure.

Figure 2:
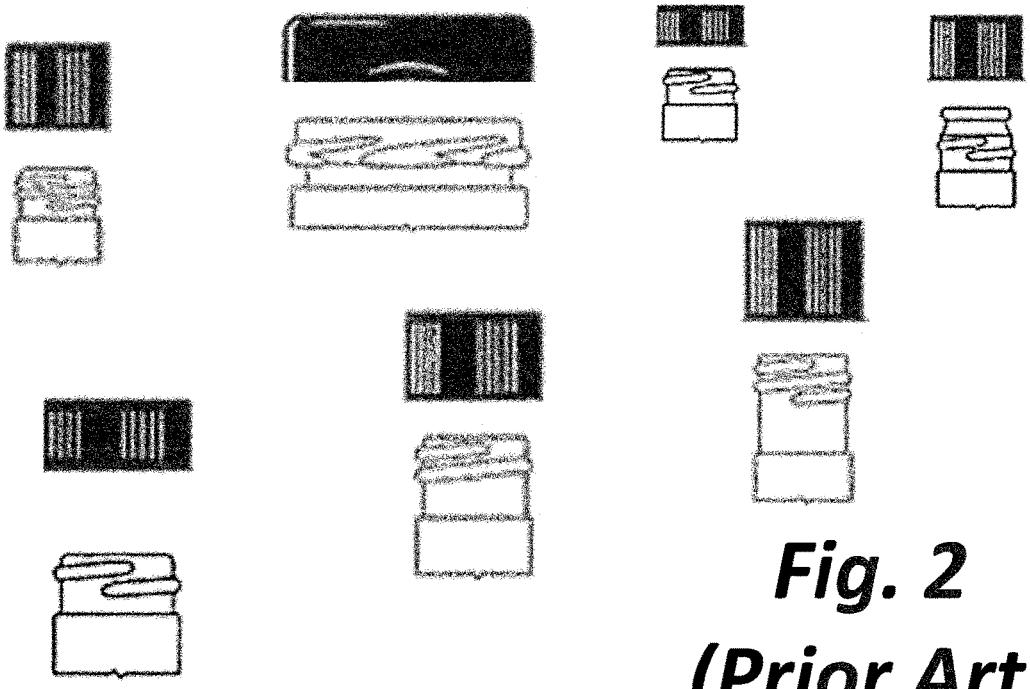
Fig. 2 (Prior Art)
FIG. 2 is an illustration of various container neck and cap arrangements known in the prior art.

Just as containers vary in design, threaded caps adapted to be attached to the threaded necks of containers vary in design. Examples in common use are shown in FIG. 2. Design differences relate to the diameter of the cap, the height of the cap and the thread configuration of the cap (as well as the corresponding thread configuration of the neck of the containers).

Figure 3:
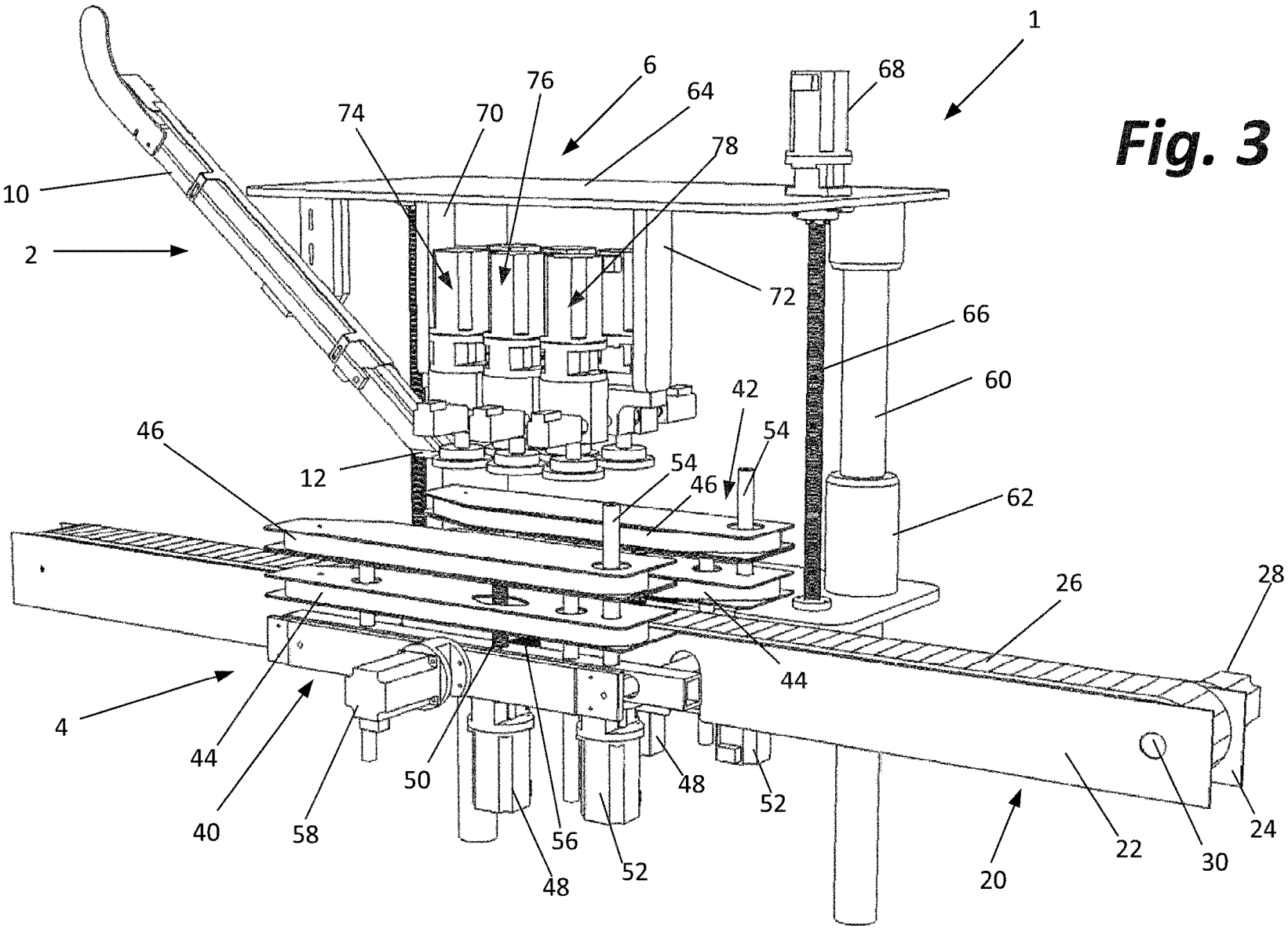
FIG. 3 is a perspective view of a universal synchronized capping machines made in accordance with the present invention.

FIG. 3 shows a machine 1 which may be employed to cap any of the containers of FIG. 1 (and virtually any other similar container) with corresponding threaded caps such as those shown in FIG. 2.

Figure 5:
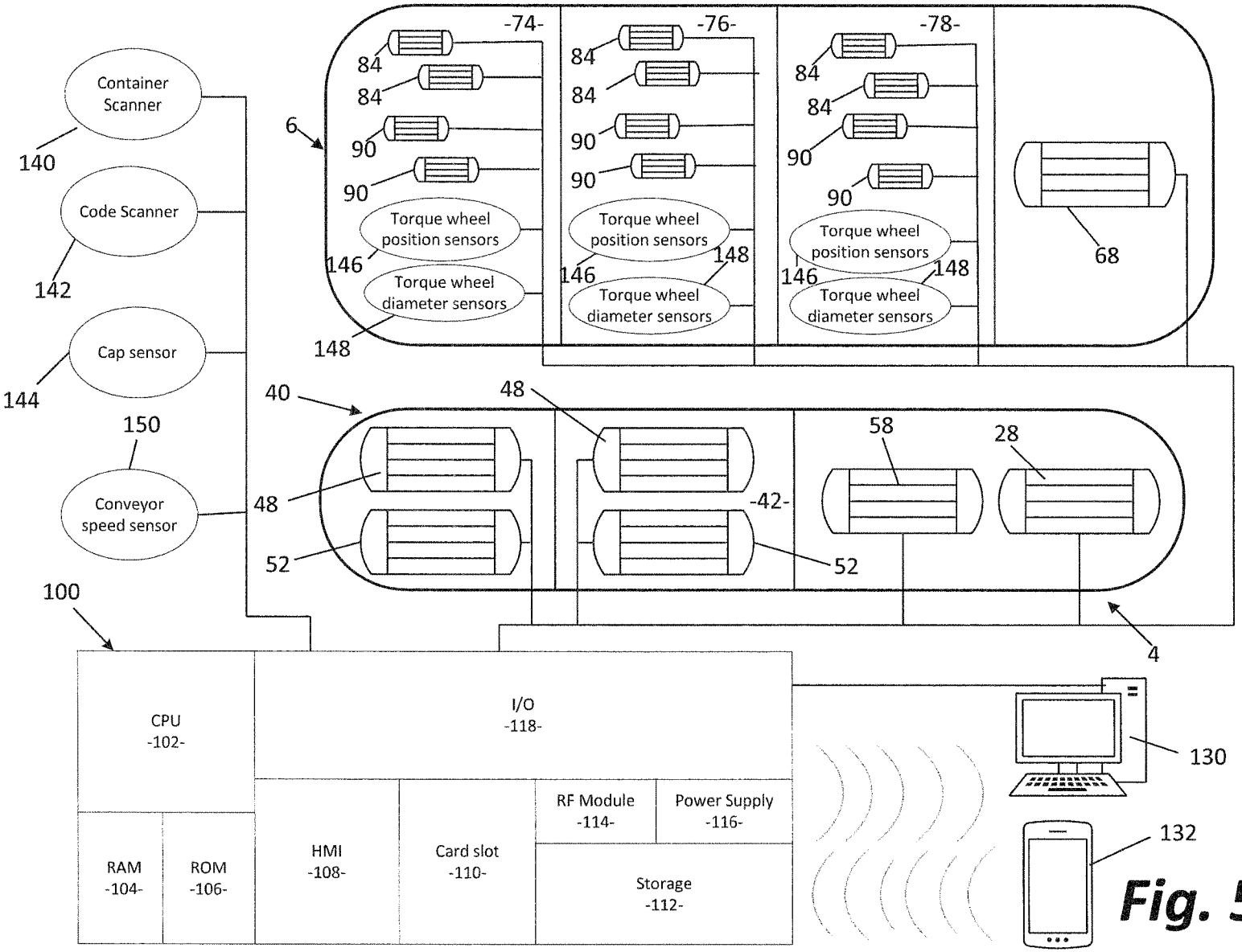
FIG. 5 is a schematic of the electronics used to control the machine of FIG. 3.

The machine 1 includes a cap delivery module 2, a container conveyor module 4, a modular torque assembly 6, and a controller 100. The controller 100 is illustrated in FIG. 5.

The cap delivery module 2 comprises a cap chute 10 which carries caps from a cap orienting machine (e.g., the cap orienting machine shown in U.S. Pat. No. 9,440,801 referenced above) to a cap foot 12. Container caps are carried by the chute 10 in single file down to the cap foot 12. As containers pass under the cap foot 12, the caps are deposited over the opening of each container.

The containers are carried in single file by the container conveyor module 4. The container conveyor module 4 includes a frame 20 having frame members 22 adjacent a first side and a frame member 24 adjacent a second opposing side of a horizontally oriented conveyor (e.g., belt) 26. Various conveyor supports (not shown) are rotatably mounted between the frame members 22 and 24 and carry the horizontally oriented conveyor 26. Mounted adjacent to one end of the frame 20 is a horizontal conveyor motor 28. A drive shaft 30 extends from the motor 28 and through the frame 20. Motor 28 and shaft 30 are adapted to drive the horizontally oriented conveyor 26 in a continuous manner at a controlled variable speed.

The container conveyor module 4 also includes a first gripper belt assembly 40 mounted adjacent the first side of the conveyor 26 and a second gripper belt assembly 42 mounted adjacent the opposing second side of the conveyor 26. Each gripper belt assembly 40/42 comprises a lower vertically oriented gripper belt 44 and an upper vertically oriented gripper belt 46.

Each gripper assembly 40/42 has a motor 48 coupled to a screw (Jack) shaft 50. Motor 48 and screw shaft 50 are used to set and adjust the distance between the lower gripper belt 44 and upper gripper belt 46. Each gripper assembly 40/42 also has a motor 52 and a drive shaft 54. Motor 52 and drive shaft 54 are used to drive the upper and lower gripper belts 44 and 46 at a controlled, variable speed synchronized with the speed of conveyor 26. The conveyor module 4 also has a screw shaft 56 extending between the two gripper assemblies 40/42. Screw shaft 56 is driven by a motor 58 to set and control the distance between the two gripper assemblies 40/42.

The modular torque assembly 6 is mounted generally above the container conveyor module 4. As shown in FIG. 3, the modular torque assembly 6 includes the mount comprising a pole 60 received within a collar 62 in a vertically slidable fashion and a plate 64. A screw shaft 66 extends parallel to the pole 60 and is coupled to a motor 68 that is operable to turn screw shaft 66 to raise and lower the plate 64. A pair of brackets 70/72 are mounted to the underside of plate 64. These brackets are adapted to carry one or more torque modules.

Figure 4:
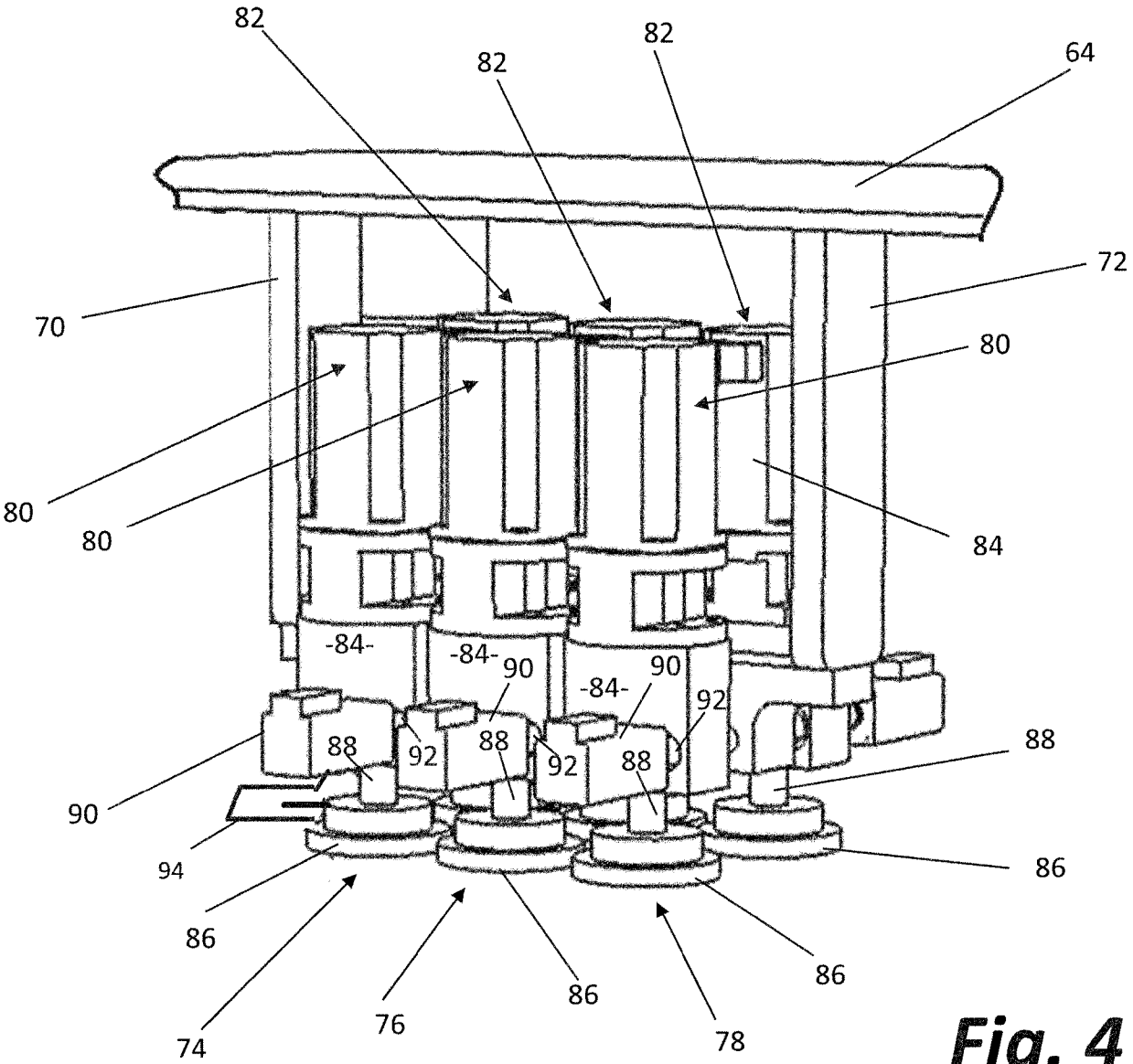
FIG. 4 is a partial perspective view of the machine of FIG. 3 showing the torque modules of the machine of FIG. 3.

Three torque modules 74, 76 and 78 are shown in FIGS. 3 and 4. The number of torque modules employed may vary depending on the rate at which the machine caps containers. The more torque modules employed the greater the number of containers that can be capped in a given unit of time.

Each torque module 74, 76, 78 includes a first torque unit 80 and a second torque unit 82. Each torque unit 80/82 comprises a motor 84 and torque wheel 86 coupled to the motor 84 by a drive shaft 88. Each torque module further includes a motor 90 and screw shaft 92 extending through the first and second torque units. The motor 90 and shaft 92 are employed to set and control the distance between the torque wheels 86 of the torque module.

The modular torque assembly 6 also includes a cap restraint 94 associated with the first torque module (as shown in FIG. 4, torque module 74) that encounters the containers and caps as they are carried through the machine to be tightened. The cap restraint 94 applies a downward pressure on the cap as the torque wheels 86 of torque module 74 impart a rotational tightening motion of the cap relative to the container. This prevents the cap from dislodging from the container before the threads of the cap begin to mesh with the threads of the container. Once the threads of the bottle and container begin to mesh, such downward pressure is no longer required to keep the cap in place on the container. As such, the torque modules 76 and 78 are not associated with a similar cap restraint.

All of the motors described above are independently controlled by a controller 100 illustrated in FIG. 5. Controller 100 comprises a CPU 102, a memory module comprising random access memory (RAM) 104 and read-only memory (ROM) 106, a human-machine interface (HMI) (e.g., a display and keyboard) 108, a card slot 110 able to receive a memory card such as a SD or compact flash card, storage 112 which may be a hard drive or a solid state drive (SSD), a RF module (e.g., a Wi-Fi, a Bluetooth or proprietary transceiver) 114, which permits the controller to communicate wirelessly with devices such as a computer 130 or even a smartphone 132. The controller 100 also includes a power supply 116 and an I/O card 118 which contains a variety of ports (e.g., USB or Ethernet ports).

The controller 100 is electronically coupled to each of the motors of the modular torque assembly 6. The two motors 84 of each torque module 74, 76, 78 are adapted to be controlled by the controller 100. The motor 90 of each torque module may be a servo motor, in which case each torque module may be provided with a sensor 146. Sensor 146 sends position feedback signals to the controller 100 to help the controller 100 control the distance between the two wheels 86 of each torque module 74, 76, 78. Alternatively, the motors 90 may be stepper motors which eliminate the need for the position sensor.

Additionally, each torque module has two torque wheel diameter sensors 148, one for each torque wheel 86. These sensors, as the name implies, send signals to the controller 100 representative of the diameter of the associated torque wheel.

In FIG. 5, the motor 68 used to raise and lower the torque assembly 6 is a stepper motor. As was the case with the motors 90, a servo motor and position sensor may be employed instead of a stepper motor. Many servo motors, when sold, come equipped with such a sensor.

The controller 100 is also electrically coupled to each of the motors of the container conveyor module 4. At least the motors 48 of each gripper belt assembly 40/42 will either be a servo motor with a position sensor or a stepper motor to permit the controller to set the distances between the lower gripper belts 44 and upper gripper belts 46. Likewise, motor 58 is either a servo motor with a sensor or a stepper motor to enable the controller 100 to properly set the distance between the two gripper belt assemblies 40 and 42.

Various other sensor arrays may be employed to provide information to the controller. In FIG. 5, three are shown. Sensor array 140 scans the container to send signals to the controller 100 from which the controller may precisely ascertain all material dimensions of the container and make micro-adjustments to the height of the modular torque assembly 6, the distance between the wheels 86 of each torque module, the distance between the two gripper belt assemblies 40 and 42, the distance between the lower and upper gripper belts 44 and 46. Micro-adjustments may also be made by the controller 100 to speeds of conveyor 26, gripper belts 44 and 46, and the torque wheels 46. Likewise, the container scanner array 140 can be used to measure a sample container to enable the controller 100 to set up the machine prior to a production run.

More specifically, sensor array 140 detects the height of the container, the shape of the container, the cross-sectional dimensions at various positions along the height of the container, the diameter and height of the neck of the container, and the pitch, length and a number of threads of the container. Alternatively, the container scanner 140 can be a camera that takes one or more digital images of a container and the controller 100 can ascertain such dimensions and data from the digital photo(s).

In some cases, sets of material container and cap measurements corresponding to a particular container and cap combination may be stored in a database maintained in storage 112 of the controller 100. These sets are each assigned to an individual identification code also stored in the database. Indicia corresponding to these codes may be used in labeling each lot of containers/caps to be used. Any operator may use the code scanner 142 to scan the indicia on the label. Signals representative of the code are then sent to the controller 100. The controller 100 then uses the code to select the corresponding set of preprogrammed measurements and uses those measurements to automatically set up the machine by sending signals to various motors. Such codes or sets of measurements may alternatively be supplied to the controller using either computer 130 or smartphone 132 or the controller's HMI 108.

In container filling plants, it is crucial that each and every container be sealed, i.e., capped. Thus, cap sensor 144 is typically an array of sensors that sends cap information to the controller 100 similar to the information sent to the controller 100 about the container by sensor 140. The array 144 also signals to the controller to stop the capping process if there is not a cap placed on the container by the cap delivery module 2, and specifically cap foot 12.

FIG. 6 shows various inputs 200, 202, 204, 206, 208, 210 and 212 on the left used by the controller 100 to automatically set up and operate the machine. Specifically, inputs 200 provide the controller 100 with information necessary for the controller 100 to calculate the dimensions of a container (e.g., bottle) at step 201. This information may be derived from a container sensor array, a camera, a CAD drawing of the container supplied electronically to the controller (e.g., via card slot 110), or a set of user inputs supplied using either the controller's HMI 108, a computer 130 or a smartphone (or tablet) 132. In a similar manner, input 202 provides the controller 100 with information necessary for the controller to calculate the dimensions of a cap (e.g., closure) at step 203.

At step 210, the operator can input a desired torque that should be employed when coupling caps to the container. Any of the inputs can be dynamically updated as indicated at 212. This is particularly true of the distance between the torque wheels, the diameter of the torque wheels and the speed of the conveyor because sensor inputs related to these characteristics are constantly delivered to the controller as indicated at steps 204-208. Likewise, at steps 203, 205, 207 and 209 the controller 100 is continuously calculating these dimensions based on the sensor inputs.

As further illustrated in FIG. 6, the container dimensions calculated at step 201 are used by the controller at step 220 to determine the proper distance between the lower and upper gripper belts 44/46 of each of the two gripper belt assemblies, and to calculate the proper distance between the two gripper belt assemblies at step 222. At step 221, the motors 48 of the two gripper belt assemblies are operated to adjust the distance between the upper and lower gripper belts based on the dimensions of the container, and at step 223 motor 58 is operated to adjust the distance between the two gripper belt assemblies.

Based on the container dimensions calculated at step 201 and the cap dimensions calculated at step 203, the controller calculates the required height of the modular torque assembly (more specifically, the height of the torque wheels) at step 224. At step 225, motor 68 is actuated to set the torque wheels 86 to the proper height. Likewise, the calculations made at steps 203, 205 and 207 are used at step 226 to calculate the proper distance between the torque wheels 86 of each torque module 74, 76, 78. At step 227, the motor 90 of each torque module is operated to move the torque wheels the proper distance apart.

At step 228, the controller 100 uses the speed of conveyor 26 (determined at step 209) and the container dimensions (calculated at step 201) to calculate the speed at which the gripper belts 44 and 46 of the two gripper belt assemblies 40 and 42 should move to maintain a desired gap between two containers passing through the machine. This calculation is then used by controller 100 at step 229 to control the motors 52 of the gripper belt assemblies 40/42 and, thus, the speed of the gripper belts 44/46.

At step 230 the controller 100 calculates the required speed of the torque wheels 86 based on the diameter of the wheels calculated at step 207, the speeds of the gripper belts 44 and 46 calculated at step 228, and the conveyor speed determined at step 209. At step 232, the speed at which the motors 84 operate is adjusted accordingly.

At step 234, torque feedback is measured to determine that each cap has been properly tightened onto the container. This measurement is used by the controller 100 to make any micro-adjustments that may be necessary. Likewise, this data may be stored in storage 112 for verification, quality control or recordkeeping purposes at step 236.

This invention has been described herein in considerable detail in order to comply with the patent statutes and to provide those skilled in the art with the information needed to apply the novel principles and to construct and use embodiments of the example as required. However, it is to be understood that the invention can be carried out by specifically different devices and that various modifications can be accomplished without departing from the scope of the invention itself.

What is claimed is:

1. An apparatus for automatically applying threaded caps to threaded necks of containers of varying designs comprising:

a. a cap delivery module comprising a cap chute, and a cap foot adapted to present caps to the top of the container;

b. a container conveyor module comprising a horizontally oriented conveyor driven by a first motor coupled to a first shaft, said horizontally oriented conveyor having a first side and a second side, a first gripper belt assembly mounted adjacent the first side of said horizontally oriented conveyor, a second gripper belt assembly mounted adjacent the second side of said horizontally oriented conveyor, each of said first and second gripper belt assemblies comprising a lower vertically oriented gripper belt and an upper vertically oriented gripper belt, a second motor coupled to a second shaft and adapted to simultaneously drive the lower vertically oriented gripper belt and the upper vertically oriented gripper belt, and a third motor coupled to a third shaft adapted to alter the distance between the lower vertically oriented gripper belt and an upper vertically oriented gripper belt, said conveyor module further comprising a fourth motor coupled to a fourth shaft operable to alter the distance between the first gripper belt assembly and the second gripper belt assembly;

c. a modular torque assembly comprising a fifth motor and a fifth shaft for adjusting the height of the modular torque assembly relative to the horizontally oriented conveyor of the container conveyor module, a cap restraint, and at least one torque module comprising a first torque unit and a second torque unit, each of said first and second torque units comprising a sixth motor and a torque wheel coupled to the sixth motor by a sixth shaft driven by the sixth motor, said at least one torque module further comprising a seventh motor coupled to a seventh shaft adapted to alter the distance between the torque wheels of the first and second torque units; and d. a controller operated under program control adapted to independently and automatically control the operation of the first motor to control the speed of the horizontally oriented conveyor, the second motor of the first gripper belt assembly to control the speed of the lower vertically oriented gripper belt and the upper vertically oriented gripper belt of the first gripper belt assembly, the second motor of the second gripper belt assembly to control the speed of the lower vertically oriented gripper belt and the upper vertically oriented gripper belt of the second gripper belt assembly, the third motor of the first gripper belt assembly to control the distance between the lower vertically oriented gripper belt and an upper vertically oriented gripper belt of the first gripper belt assembly, the third motor of the second gripper belt assembly to control the distance between the lower vertically oriented gripper belt and an upper vertically oriented gripper belt of the second gripper belt assembly, the fourth motor to control the distance between the first gripper belt assembly and the second gripper belt assembly, the fifth motor to control the height of the modular torque assembly relative to the horizontally oriented conveyor of the container conveyor module, the sixth motor of the first torque unit of said at least one torque module to control the speed and torque of the wheel of said first torque unit, the sixth motor of the second torque unit of said at least one torque module to control the speed and torque of the wheel of said second torque unit, and the seventh motor to control the distance between the torque wheels of the first and second torque units.

2. The apparatus of claim 1 wherein said modular torque assembly comprises a plurality of torque modules, each of said torque modules comprising a first torque unit and a second torque unit, each of said first and second torque units comprising a sixth motor and a torque wheel coupled to a sixth shaft driven by the sixth motor, and a seventh motor coupled to a seventh shaft adapted to alter the distance between the torque wheels of the first and second torque units, and wherein each of said sixth motors and seventh motors are independently controlled by said controller.

3. The apparatus of claim 1 further including a plurality of sensors coupled to the controller and providing signals to the controller which the controller uses to control the operation of at least some of the motors.

4. The apparatus of claim 3 wherein at least one of said sensors provides signals to the controller representative of the configuration of a container carried by the container conveyor module.

5. The apparatus of claim 4 wherein the controller, in response to the signals representative of the configuration of a container carried by the container conveyor module, sends commands to the third motors to adjust the distances between the lower vertically oriented gripper belt and the upper vertically oriented gripper belt of each gripper belt assembly, to the fourth motor to alter the distance between the first gripper belt assembly and the second gripper belt assembly, and to the fifth motor to adjust the height of the modular torque assembly relative to the horizontally oriented conveyor of the container conveyor module.

6. The apparatus of claim 3 wherein one of said sensors provides signals to the controller representative of the configuration of a cap carried by the cap delivery module.

7. The apparatus of claim 6 wherein the controller, in response to the signals representative of the configuration of a cap carried by the container conveyor module, sends commands to the seventh motor to control the distance between the torque wheels of the first and second torque assemblies.

8. The apparatus of claim 3 wherein said controller includes a processor, memory, storage, an input/output module to which the sensors and motors are electronically coupled, and a human/machine interface.

9. The apparatus of claim 8 wherein the controller is adapted to permit a mobile storage device to be coupled to the controller so that data stored on the mobile storage device may be read by the controller.

10. The apparatus of claim 8 wherein the controller further includes a port adapted to permit a peripheral computing device to be electrically coupled to the controller.

11. The apparatus of claim 1 wherein the controller controls the speeds of the first motor, the second motors and the sixth motors to coordinate the speeds of the horizontally oriented conveyor, the gripper belts and the torque wheels.

12. The apparatus of claim 1 wherein the controller further includes a wireless transceiver module adapted to permit the controller to communicate wirelessly with other devices.

13. The apparatus of claim 12 wherein the wireless transceiver module communicates using a standard communications protocol.

* * * * *